US011088476B2

(12) United States Patent
Ito

(10) Patent No.: US 11,088,476 B2
(45) Date of Patent: Aug. 10, 2021

(54) BOARD CONNECTOR WITH CHAINED TERMINALS

(71) Applicant: Sumitomo Wiring Systems, Ltd., Yokkaichi (JP)

(72) Inventor: Toshihiro Ito, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/799,898

(22) Filed: Feb. 25, 2020

(65) Prior Publication Data

US 2020/0274270 A1 Aug. 27, 2020

(30) Foreign Application Priority Data

Feb. 27, 2019 (JP) ..... JP2019-033874

(51) Int. Cl.

| | |
|---|---|
| ***H01R 12/55*** | (2011.01) |
| ***H01R 12/70*** | (2011.01) |
| ***H01R 43/16*** | (2006.01) |
| ***H01R 9/16*** | (2006.01) |

(52) U.S. Cl.

CPC ..... *H01R 12/7064* (2013.01); *H01R 9/16* (2013.01); *H01R 12/55* (2013.01); *H01R 43/16* (2013.01)

(58) Field of Classification Search

CPC .... H01R 12/7064; H01R 12/55; H01R 43/16; H01R 9/16; H01R 12/724; H01R 43/205; H01R 13/41; H01R 12/585

See application file for complete search history.

(56) References Cited

U.S. PATENT DOCUMENTS

| | | | | |
|---|---|---|---|---|
| 3,955,877 | A * | 5/1976 | Cobaugh | H01R 12/585 439/853 |
| 5,875,546 | A * | 3/1999 | Cachina | H01R 43/0235 29/843 |
| 5,957,739 | A * | 9/1999 | Bianca | H01R 12/57 439/885 |
| 6,062,871 | A * | 5/2000 | Arai | H01R 12/714 439/66 |
| 6,155,886 | A * | 12/2000 | Koseki | B29C 45/14639 439/736 |
| 6,848,955 | B2 * | 2/2005 | Kojima | H01R 13/03 29/885 |
| 10,044,121 | B2 * | 8/2018 | Shimizu | H01R 12/585 |
| 2002/0002007 | A1 * | 1/2002 | Endo | H01R 43/16 439/625 |

(Continued)

FOREIGN PATENT DOCUMENTS

| | | |
|---|---|---|
| JP | 2005-183298 | 7/2005 |
| JP | 2010-257924 | 11/2010 |
| JP | 2013-197001 | 9/2013 |

*Primary Examiner* — Truc T Nguyen

(74) *Attorney, Agent, or Firm* — Gerald E. Hespos; Michael J. Porco; Matthew T. Hespos

(57) ABSTRACT

Chained terminals include a strip-like carrier and terminals arranged side by side in a longitudinal direction of the carrier. The terminal includes a base portion constituting a part of the carrier and projecting portions respectively connected to the base portion and projecting in opposite directions from both side edges of the carrier. The carrier includes notches at positions distant from the projecting portions at least on one side edge. The terminals are cut off from the carrier along cutting surfaces passing through the notches.

6 Claims, 6 Drawing Sheets

(56) References Cited

U.S. PATENT DOCUMENTS

| | | | | |
|---|---|---|---|---|
| 2003/0017752 | A1* | 1/2003 | Okamoto | H01R 43/24 439/736 |
| 2005/0070139 | A1* | 3/2005 | Kaneko | H01R 12/585 439/82 |
| 2005/0079774 | A1* | 4/2005 | Fujii | H01R 43/16 439/884 |
| 2006/0178023 | A1* | 8/2006 | Matsumura | H01R 43/20 439/76.1 |
| 2010/0112834 | A1* | 5/2010 | Chen | H01R 43/16 439/78 |
| 2012/0291278 | A1* | 11/2012 | Sakamoto | H01R 12/55 29/876 |
| 2013/0149904 | A1* | 6/2013 | Shiratori | H01R 24/00 439/626 |
| 2013/0273782 | A1* | 10/2013 | Muro | H01R 12/57 439/626 |
| 2015/0188273 | A1* | 7/2015 | Endo | H01R 43/16 29/874 |
| 2016/0079715 | A1* | 3/2016 | Tsubo | H01R 12/79 439/620.21 |
| 2017/0077619 | A1* | 3/2017 | Seipel | H01R 43/16 |
| 2017/0302016 | A1* | 10/2017 | Watanabe | H01R 13/03 |

* cited by examiner

BOARD CONNECTOR WITH CHAINED TERMINALS

BACKGROUND

Field of the Invention. The disclosure relates to chained terminals and a board connector with terminals in chained terminals.

Related Art. Chained terminals disclosed in Japanese Unexamined Patent Publication No. 2010-257924 include a strip-like carrier and terminals (internal terminals) having projections (parts including circuit board connecting portions and electrical contact portions) projecting in opposite directions from both side edges of the carrier. The terminals are cut at carrier connecting/cutting positions to be separated from the carrier and are mounted into a housing of a circuit board connector. The carrier connecting/cutting positions are set in recesses continuous with the projections. Techniques for cutting off terminals from a carrier is disclosed in Japanese Unexamined Patent Publication No. 2005-183298 and Japanese Unexamined Patent Publication No. 2013-197001.

The terminals have cut surfaces at the carrier connecting/cutting positions, and burrs due to cutting are formed on the cutting surfaces of the terminals. If the terminals are mounted into the housing with the burrs remaining on the cutting surfaces and the housing is disposed on a circuit board, the burrs may fall down on the circuit board to cause troubles.

This disclosure provides chained terminals and a board connector with improved quality.

SUMMARY

Chained terminals of the present disclosure include a strip-like carrier, and terminals arranged side by side in a longitudinal direction of the carrier. The terminal includes a base constituting a part of the carrier and projections connected to the base and projecting in opposite directions from both side edges of the carrier. The carrier includes recesses at positions distant from the projections at least on one side edge.

According to the present disclosure, it is possible to provide chained terminals of improved quality.

If the carrier is cut at positions passing through the recesses, the terminals are formed with cutting surfaces. However, the cutting surfaces can be made smaller by the recesses. Thus, when the terminals are mounted into a housing of a board connector, the cutting surfaces are easily located inside the housing and burrs remaining on the cutting surfaces can be prevented from falling down on a circuit board. Further, the recesses are arranged at the positions distant from the projecting portions. Thus, parts of the terminals between parts of the recesses (divided recesses) and the projecting portions on the one side edge of the carrier easily are located outside the housing and can be used as exposed surfaces when mounting the terminals into the housing.

The recesses may be provided on both sides across the projections only on the one side edge. Thus, the strength of the carrier is not reduced more than necessary. Further, since the recesses are provided on the both sides across the projections, the cutting surfaces are positioned more easily inside the housing by cutting the carrier at positions passing through the respective recesses.

One projection may include a resiliently deformable press-fit portion, and the recesses may be located on a side where the press-fit portions are located. According to this configuration, since the recesses can be partially located inside the housing when the carrier is cut at the positions passing through the recesses, burrs remaining on the cutting surfaces can be prevented from falling down on the side where the press-fit portions are located. As a result, performances of the press-fit portions can be ensured.

A board connector with the terminals described above includes the terminals cut off from the carrier along cutting surfaces passing through the recesses, and a housing including insertion holes. The bases are inserted into the insertion holes. One projection may be connected to a circuit board outside the housing and the other projecting portion may be connected to a mating terminal inside housing. The base has the cutting surface, a divided recess constituting a part of the recess and an exposed surface connecting the divided recess and the projecting portion on the one side edge. The cutting surface is arranged to face an inner surface of the insertion hole, and the exposed surface is arranged in an exposed manner outside the housing. Since the cutting surfaces are arranged to face the inner surfaces of the insertion holes, burrs due to cutting can be prevented from falling down on a circuit board. On the other hand, since the exposed surfaces are arranged in an exposed manner outside the housing, a tool for assembling can easily be brought into contact with the exposed surfaces. As a result, the terminals can be mounted easily into the housing. By providing the divided recesses between the cutting surfaces and the exposed surfaces, a structure for locating the cutting surfaces inside the housing and locating the exposed surfaces outside the housing can be built easily.

The cutting surfaces may be spaced from the inner surfaces of the insertion holes. According to this configuration, the burrs remaining on the cutting surfaces can be accommodated between the inner surfaces of the insertion holes and the cutting surfaces.

A specific example of the disclosure is described below with reference to the drawings. Note that the invention is not limited to this illustration and is intended to be represented by claims and include all changes in the scope of claims and in the meaning and scope of equivalents.

DETAILED DESCRIPTION

Figure 1:
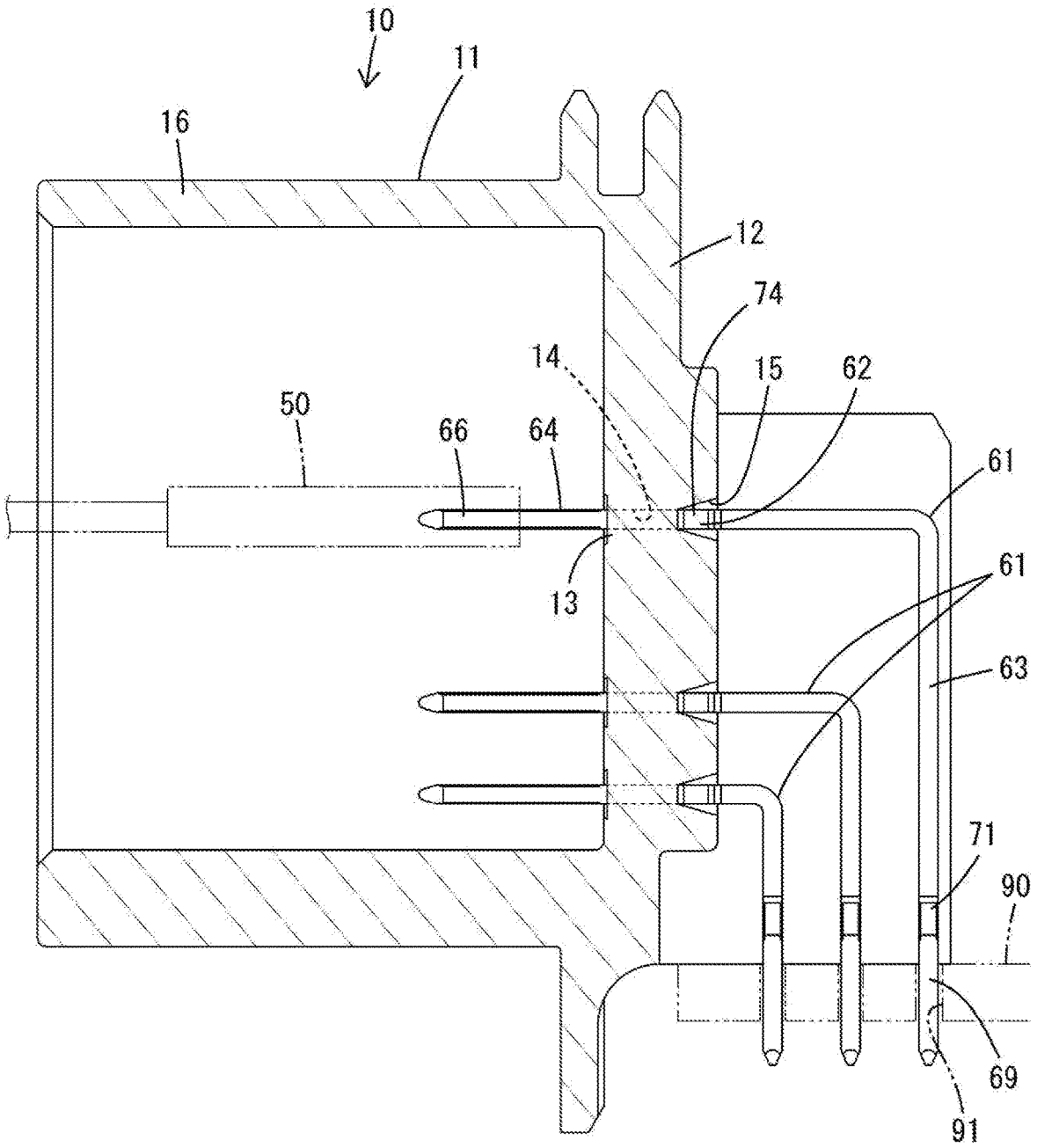
FIG. 1 is a side view in section of a board connector according to an embodiment.

A board connector 10 according to an embodiment is disposed on a circuit board 90. The board connector 10 includes a housing 11 made of synthetic resin and terminals 61 made of conductive metal. The terminals 61 are cut off from chained terminals 60.

<Housing 11>

As shown in FIG. 1, the housing 11 includes a back wall 12 arranged to stand in a vertical direction, which is a direction perpendicular to a plate surface of the circuit board 90. The housing 11 includes a tubular receptacle 16 projecting forward (left of FIG. 1) from an outer peripheral part of the back wall 12. The receptacle 16 is fittable to an unillustrated mating housing.

Figure 2:
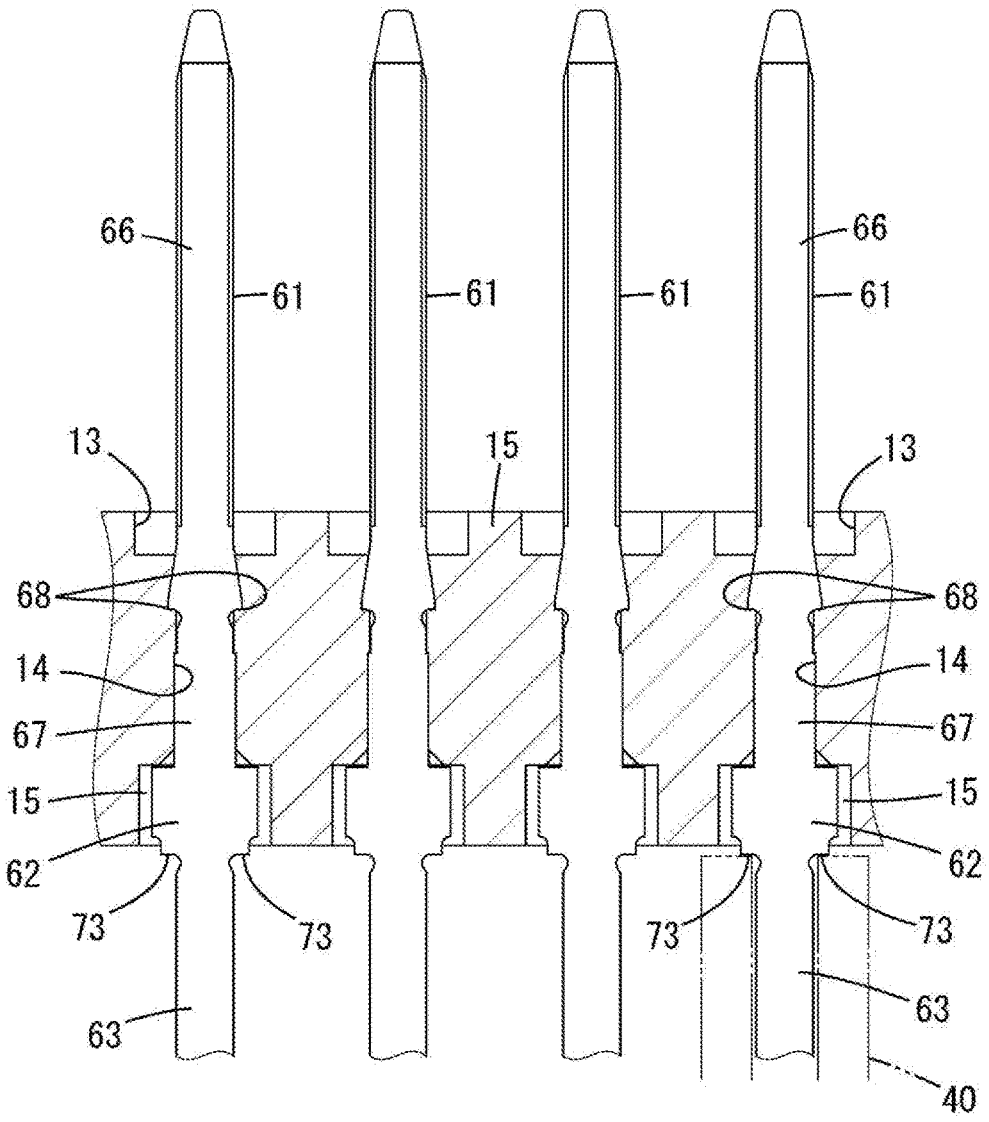
FIG. 2 is a plan view in section showing terminals mounted in a housing.

The back wall 12 includes holes 13, 14 and 15 arranged in three stages in the vertical direction in the back wall 12. As shown in FIG. 2, the holes 13, 14 and 15 are arranged side by side in a width direction (lateral direction of FIG. 2).

Figure 3:
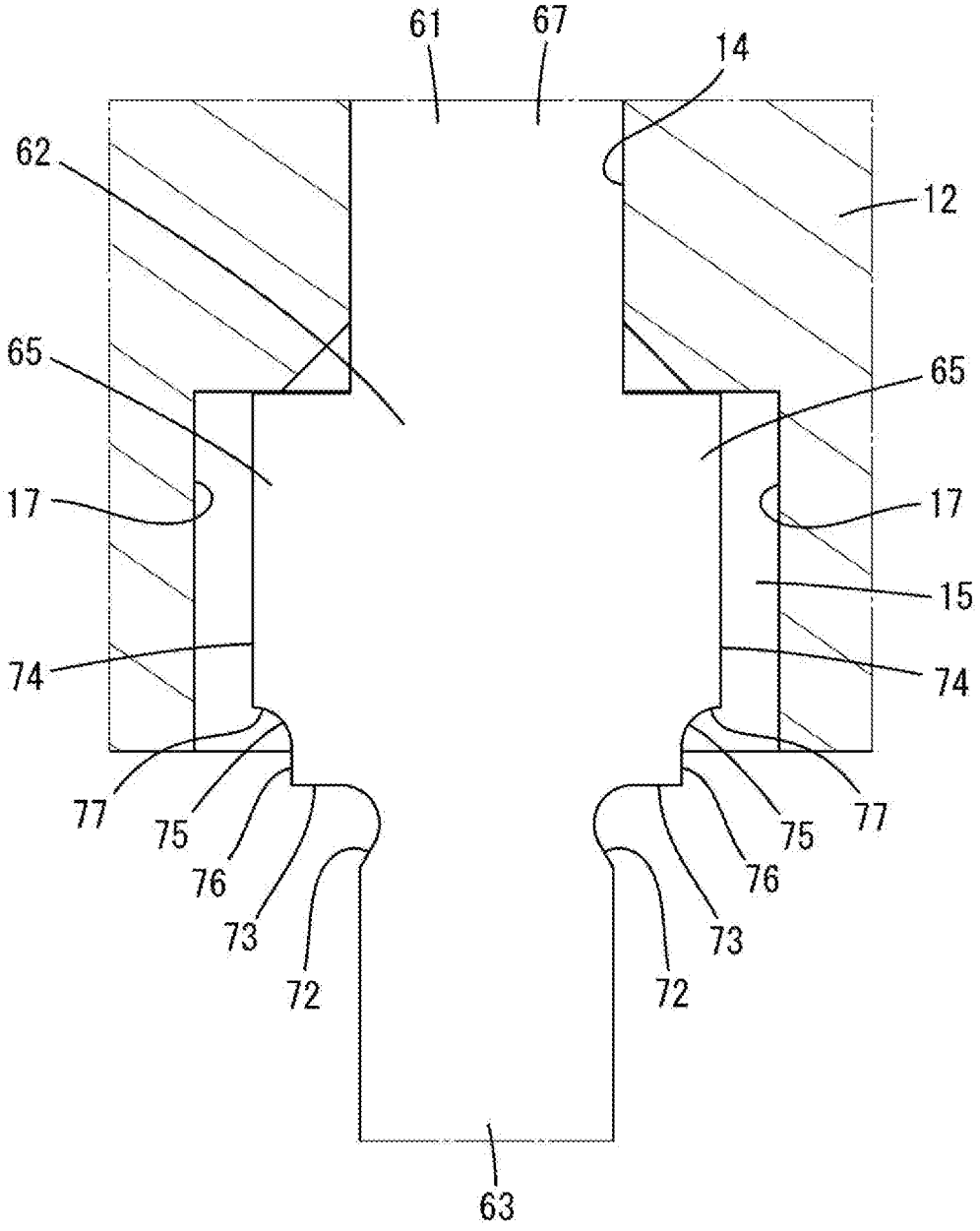
FIG. 3 is an enlarged view of an essential part of FIG. 2.

Each hole 13, 14 and 15 includes a recessed hole 13 open in the front surface of the back wall 12, an insertion hole 15 open in the rear surface of the back wall 12 and a press-fit hole 14 located between the insertion hole 15 and the recessed hole 13. The recessed hole 13, the press-fit hole 14 and the insertion hole 15 coaxially penetrate through the back wall 12 in a front-rear direction. The press-fit hole 14 has a smaller diameter (narrower width) and extends longer in the front-rear direction than the insertion hole 15 and the recessed hole 13. The insertion hole 15 extends longer in the front-rear direction than the recessed hole 13. As shown in FIG. 1, the insertion hole 15 is vertically widened toward the rear. As shown in FIG. 3, the insertion hole 15 includes two inner surfaces 17 extending along the front-rear direction and arranged to face each other in the width direction. The inner surfaces 17 are facing later-described cut surfaces 74 provided on the terminal 61 with clearances defined therebetween.

<Terminals 61>

Figure 4:
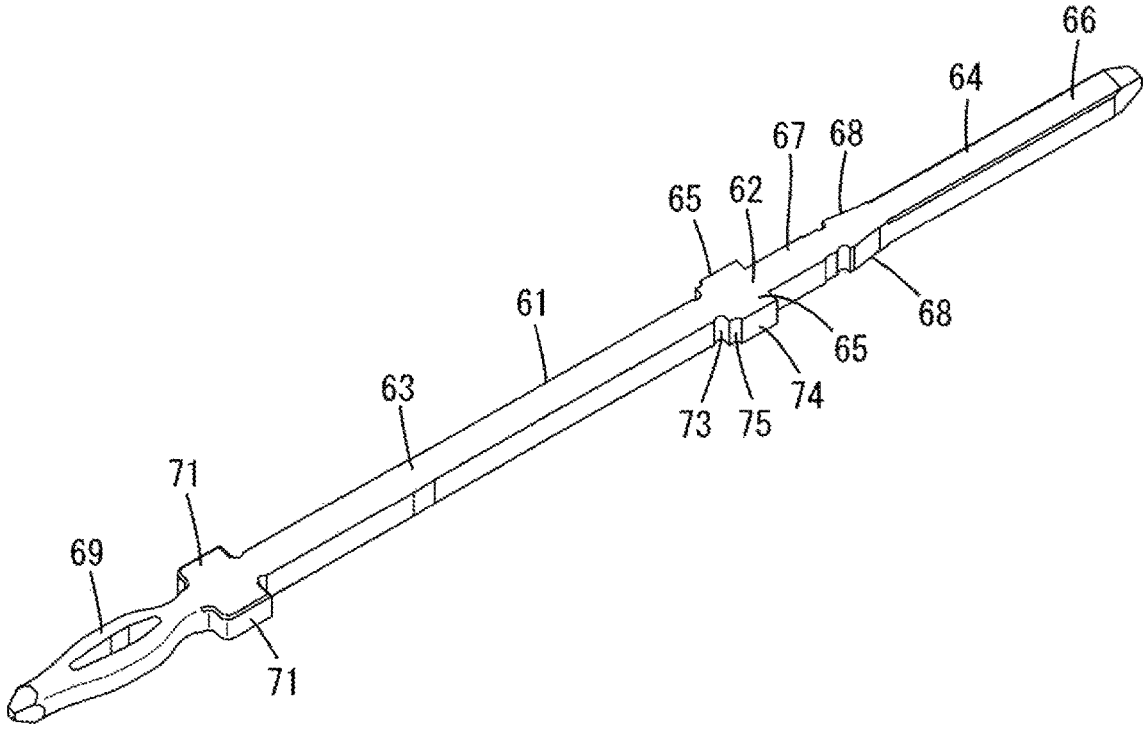
FIG. 4 is a perspective view of the terminal before bending.

The terminal 61 is formed by being bent from a metal plate constituting the chained terminals 60. Each terminal 61 before bending extends long in the front-rear direction as shown in FIG. 4.

The terminal 61 includes a base 62 arranged at an intermediate longitudinal position, a first projection 63 projecting rearward from the rear end of the base 62 and a second projection 64 projecting forward from the front end of the base 62. The base 62 is in the form of a rectangular plate and has two protruding pieces 65 protruding toward both sides in the width direction (plate width direction).

The second projection 64 includes a connecting portion 66 in a part near a tip. The connecting portion 66 has a rectangular cross-section with four chamfered corners. As shown in FIG. 1, the connecting portion 66 is connected electrically to a mating terminal 50 mounted in the unillustrated mating housing when the mating housing is fit into the receptacle 16.

As shown in FIG. 2, the second projection 64 includes a pressed portion 67 between the connecting portion 66 and the base 62. A width of the pressed portion 67 is equal to or slightly larger than a width of the press-fit hole 14 of the housing 11. The pressed portion 67 has two projecting claws 68 protruding toward both sides in the width direction in a part near the connecting portion 66. The projecting claws 68 have pointed tips that bite into the inner surface of the press-fit hole 14 of the housing 11 when the pressed portion 67 is press-fit into the press-fit hole 14 of the housing 11. In this way, the terminal 61 is retained and held in the housing 11.

As shown in FIG. 4, the first projection 63 extends longer than the second projection 64. The first projection 63 includes a press-fit portion 69 in a tip part. The press-fit portion 69 has a curved shape bulging toward both widthwise sides and is resiliently deformable in the width direction. The first projection 63 includes a pair of rectangular projecting pieces 71 protruding toward both sides in the width direction at a position adjacent to the press-fit portion 69.

The first projection 63 is bent in a plate thickness direction at an intermediate longitudinal position. After the first projection 63 is bent, the press-fit portion 69 is arranged so that plate surfaces extend along the vertical direction and a tip side is facing down. As shown in FIG. 1, the press-fit portion 69 is inserted into a through hole 91 of the circuit board 90 and is connected electrically to an unillustrated conductive path of the circuit board 90. The projecting pieces 71 are pressed by an unillustrated pressing tool when the press-fit portion 69 is inserted into the through hole 91.

As shown in FIG. 3, the first projection 63 has two recesses 72 in the form of concave surfaces in parts at both widthwise sides and coupled to the base 62. The first projection 63 is constricted at the recesses 72.

The base 62 has two exposed surfaces 73 on plate thickness surfaces on the rear ends of the protruding pieces 65. The exposed surfaces 73 respectively face the recesses 72 and are arranged along the width direction. The linearity of the exposed surfaces 73 along the width direction is ensured by the respective recesses 72. The base 62 has two cut surfaces 74 on plate thickness surfaces of the tips (both ends in the width direction) of the protruding pieces 65 in protruding directions. The cut surfaces 74 are arranged along the front-rear direction, which is a direction perpendicular to the exposed surfaces 73. A dimension of the cut surfaces 74 in the front-rear direction is smaller than that of the inner surfaces 17 in the front-rear direction.

The base 62 is inserted into the insertion hole 15 of the housing 11 from behind. Thus, both cut surfaces 74 are located entirely in the insertion hole 15 and face parallel to the inner surfaces 17.

As shown in FIG. 3, the base 62 includes two divided recesses 75 in plate thickness surfaces at rear corners of both protruding pieces 65. Each divided recess 75 has a quadrant shape and is arranged to connect the exposed surface 73 and the cut surface 74. Specifically, the divided recess 75 is defined by a straight portion 76 extending forward in the front-rear direction from the exposed surface 73 and a curved portion 77 extending in a curved manner from the straight portion 76 to the cut surface 74.

<Chained Terminals 60>

Figure 5:
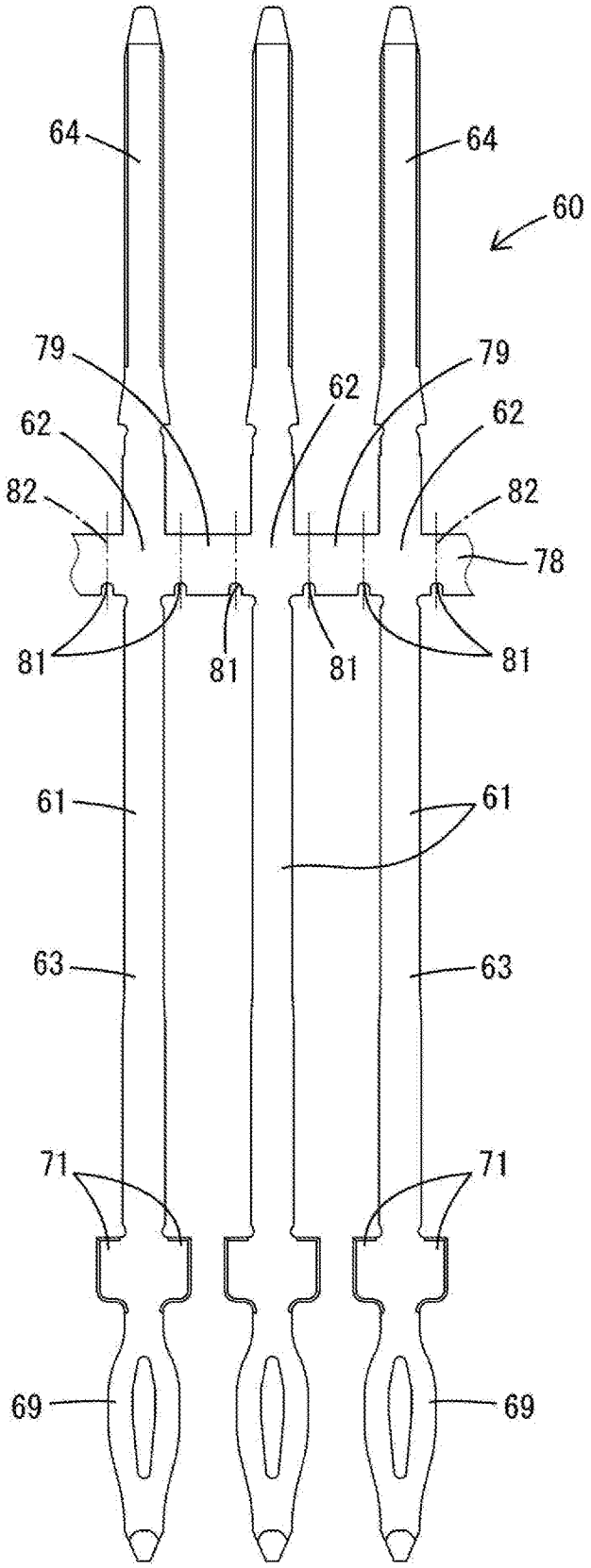
FIG. 5 is a plan view of chained terminals.

As shown in FIG. 5, the chained terminals 60 include a carrier 78 connecting the terminals 61 in a chain-like manner. The carrier 78 includes the bases 62 of the terminals 61 and couplings 79 that couple the bases 62 to each other between adjacent terminals 61. The carrier 78 is a strip extending while successively connecting the bases 62 and the couplings 79. Note that "both ends in a width direction (also front and rear ends)" of the carrier 78 are referred to as "both side edges" below.

The carrier 78 includes notches 81 on a rear edge. Each notch 81 is provided on a boundary between the base 62 and the coupling 79 of the carrier 78. No notch 81 is provided on the front edge on a front of the carrier 78.

The notches 81 are provided on both sides across the corresponding first projections 63 on one side edges of the respective couplings 79 of the carrier 78. Two notches 81 are provided between adjacent first projections 63. Specifically, each notch 81 is U-shaped in a plan view and is at a position distant from the back end of the recess 72 of the first projecting portion 63 on the one side edge of each coupling 79 of the carrier 78.

The exposed surfaces 73 of the protruding pieces 65 of each terminal 61 are provided between the notches 81 and the first projection 63 on the one side edge of the carrier 78. Each of the divided recesses 75 of the protruding pieces 65 of the terminal 61 is constituted by one side of the notch 81 divided by cutting the carrier 78 along a cutting line 82 passing through the recess 81.

<Manufacturing Method and Functions>

Plating is applied to the chained terminals 60. After plating, the carrier 78 of the chained terminals 60 is cut along each cutting line 82. In this way, each terminal 61 is cut off from the carrier 78. Each coupling 79 becomes unnecessary and is discarded. The cutting surfaces 74 of each terminal 60 become non-plated surfaces formed with no plating layer. Burrs due to cutting may be attached to the cutting surfaces 74 of each terminal 61.

The first projection 63 of each terminal 61 is bent to arrange the press-fit portion 69 facing downward. Subsequently, each terminal 61 is inserted into the respective holes 13, 14 and 15 in the back wall 12 of the housing 11 with the tip of the second projection 64 facing forward. At this time, a tool 40 for assembling is used, as shown in FIG. 2.

The tool 40 is pushed forward to move each terminal 61 forward with a tip part thereof placed on the exposed surfaces 73 of the protruding pieces 65 in each terminal 61. As shown in FIG. 3, a forward movement of the terminal 61 is stopped at a position where front surfaces of the protruding pieces 65 contact the back surface of the insertion hole 15. The pressed portion 67 of each terminal 61 is press-fit into the press-fit hole 14 and, as shown in FIG. 2, the projecting claws 68 bite into the inner surface of the press-fit hole 14. In this way, each terminal 61 is retained in the back wall 12 of the housing 11.

The exposed surfaces 73 of the protruding pieces 65 in each terminal 61 are exposed at positions projecting rearward from the rear end of the insertion hole 15. This prevents interference of the tip of the tool 40 with the rear surface of the housing 11. Further, since the tip of the tool 40 does not enter the insertion hole 15, the strength of the tip of the tool 40 is ensured. Furthermore, a degree of freedom in molding the tool 40 can be enhanced.

As shown in FIG. 3, the divided recesses 75 of the protruding pieces 65 in each terminal 61 partially project (straight portions 76) from the rear end of the insertion hole 15 and are arranged over the inside and outside of the housing 11.

The cutting surfaces 74 of the protruding pieces 65 in each terminal 61 are located entirely inside the insertion hole 15 and face parallel to the inner surfaces 17 with clearances defined between the inner surfaces 17 and the cutting surfaces 74. Here, burrs remaining on the cutting surfaces 74 can be accommodated between the cutting surfaces 74 and the inner surfaces 17 inside the insertion hole 15.

Thereafter, the housing 11 is placed on the circuit board 90. Here, since the entire cutting surfaces 74 of both protruding pieces 65 are located inside the insertion hole 15, the burrs remaining on the cutting surfaces 74 are prevented from falling down on the circuit board 90. As a result, performances of the press-fit portion 69 inserted into the through hole 91 of the circuit board 90 can be achieved satisfactorily.

The embodiment disclosed this time should be considered to be illustrative in all aspects, rather than restrictive.

Figure 6:
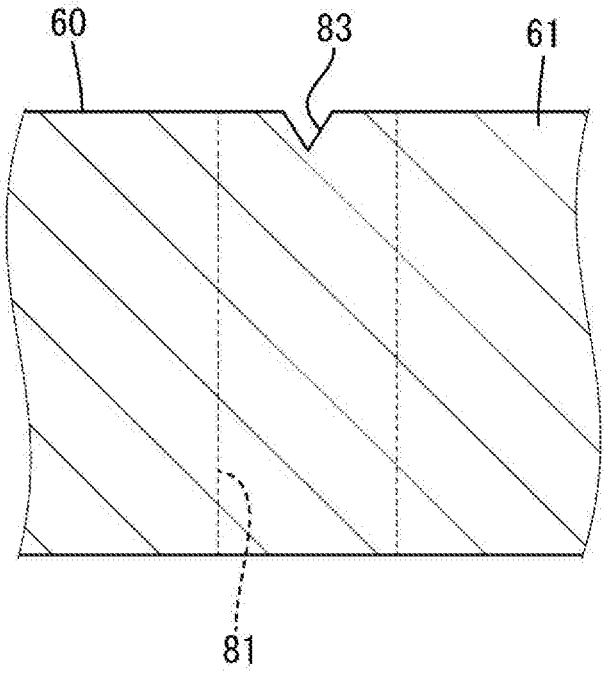
FIG. 6 is a section of an essential part showing a carrier cutting position in chained terminals according to another embodiment.

For example, the carrier 78 of the chained terminals 60 may include cutouts 83 open in widthwise central parts of the notches 81 and extending in the front-rear direction (width direction of the carrier 78) in at least one plate surface, out of both plate surfaces, as shown in FIG. 6. Each cutout 83 is in the form of a groove having a triangular cross-section and functions as an index of a cutting position in cutting off the terminal 61 from the carrier 78. Since the cutout 83 is open in the widthwise central part of the notch 81 and the carrier 78 is cut along the cutout 83, the cutting position can be determined in the widthwise central part of the notch 81. As a result, accuracy in forming the divided recess 75 can be enhanced. Further, the number of burrs formed due to cutting can be reduced.

Further, although the notches 81 are formed U-shaped in a plan view in the above embodiment, the notches 81 may be formed, for example, to have a rectangular shape, triangular shape or semicircular shape in a plan view as another embodiment. Thus, the shape of the notches 81 is not limited. Further, although the notches 81 are provided only in the one side edge of the carrier 78 in the above embodiment, the notch 81 may be provided in the both side edges of the carrier 78 as another embodiment.

Although two notches 81 are formed between the first projections 63 of the adjacent terminals 61 in the chained terminals 60 in the above embodiment, one notch 81 may be formed between the first projections 63 of the adjacent terminals 61 as another embodiment. In this case, the cutting surfaces 74 of the adjacent terminals 61 are formed along the same cutting line 82. Further, the couplings 79 need not be discarded as unnecessary parts.

Further, although the first projection 63 includes the press-fit portion 69 in the above embodiment, the first projecting portion 63 may include no press-fit portion and be connected to the circuit board by soldering as another embodiment.

LIST OF REFERENCE SIGNS

10 . . . board connector
11 . . . housing
12 . . . back wall
13 . . . recessed hole
14 . . . press-fit hole
15 . . . insertion hole
16 . . . receptacle
17 . . . inner surface
40 . . . tool for assembling
50 . . . mating terminal
60 . . . chained terminals
61 . . . terminal
62 . . . base
63 . . . first projecting portion
64 . . . second projecting portion
65 . . . protruding piece
66 . . . connecting portion
67 . . . pressed portion
68 . . . projection
69 . . . press-fit portion
71 . . . projecting piece
72 . . . recessed part
73 . . . exposed surface
74 . . . cutting surface
75 . . . divided recess
76 . . . straight portion
77 . . . curved portion
78 . . . carrier
79 . . . coupling portion
81 . . . notch
82 . . . cutting line
90 . . . circuit board
91 . . . through hole

What is claimed is:

1. A board connector, comprising:

chained terminals arranged side-by-side in a longitudinal direction of a strip-like carrier, each of the terminals includes a base constituting a part of the carrier and first and second projections connected to the base and projecting respectively in opposite directions from first and second side edges of the carrier, the carrier including notches at positions distant from the first and second projections on at least one of the first and second side edges, the terminals being cut off from the carrier along cutting surfaces passing through the notches; and a housing including insertion holes, the bases being inserted into the insertion holes, wherein:

the first projection is connected to a circuit board outside the housing and the second projection is connected to a mating terminal inside housing, the base has the cutting surface, a divided recess constituting a part of the notch and an exposed surface connecting the divided recess and the first projection on the first side edge, the cutting surface is arranged to face an inner surface of the insertion hole, and the exposed surface is exposed outside the housing.

2. The board connector of claim 1, wherein the notches are provided on opposite sides of the projections only on the first side edge of the carrier.

3. The board connector of claim 2, wherein:

each of the first projections includes a resiliently deformable press-fit portion; and the notches are located on a side where the press-fit portions are located.

4. The board connector with the terminals in the chained terminals of claim 1 the cutting surfaces are arranged at a distance from the inner surfaces of the insertion holes.

5. A board connector, comprising:

a housing with a wall having opposite first and second surfaces and including an insertion hole extending through the wall from the first surface to the second surface; and a terminal fitting formed from a metal material, the terminal fitting having a base and first and second projections projecting in opposite first and second directions from the base, the terminal fitting being mounted to the housing so that at least part of the base is in the insertion hole, the first projection projects beyond the first surface of the wall of the housing, and the second projection projects beyond the second surface of the wall of the housing, wherein:

the base has opposite cut side surfaces formed by cutting the terminal fitting from a carrier strip, the cut side surfaces of the base being disposed in the insertion hole and facing inner surfaces of the insertion hole, the base further having exposed surfaces exposed from the insertion hole and disposed so that the first projection projects in the first direction from the exposed surfaces and divided recesses extending respectively between the exposed surfaces and the cut surfaces, whereby burrs formed by cutting the base from the carrier strip are disposed in the insertion hole.

6. The board connector of claim 5, wherein all of the terminal fitting except the cut surfaces of the base have plating applied to the metal material of the terminal fitting, the cut side edges of the base having no plating thereon.

* * * * *